US009181719B2

(12) United States Patent
Jentsch

(10) Patent No.: US 9,181,719 B2
(45) Date of Patent: Nov. 10, 2015

(54) ADJUSTABLE FORMWORK CLIMBER FOR CASTING A PROTRUDING REGION OF A STRUCTURE

(75) Inventor: Michael Jentsch, Singapore (SG)

(73) Assignee: VSL INTERNATIONAL AG, Koniz (CH)

( * ) Notice: Subject to any disclaimer, the term of this patent is extended or adjusted under 35 U.S.C. 154(b) by 308 days.

(21) Appl. No.: 13/637,178

(22) PCT Filed: Apr. 14, 2010

(86) PCT No.: PCT/EP2010/054866

§ 371 (c)(1),
(2), (4) Date: Sep. 25, 2012

(87) PCT Pub. No.: WO2011/127970

PCT Pub. Date: Oct. 20, 2011

(65) Prior Publication Data

US 2013/0020732 A1 Jan. 24, 2013

(51) Int. Cl.

| | |
|---|---|
| ***E04G 21/02*** | (2006.01) |
| ***B28B 1/14*** | (2006.01) |
| ***E04G 11/28*** | (2006.01) |
| ***E04G 13/06*** | (2006.01) |

(52) U.S. Cl.
CPC . *E04G 11/28* (2013.01); *B28B 1/14* (2013.01); *E04G 13/06* (2013.01); *E04G 13/066* (2013.01); *E04G 21/02* (2013.01)

(58) Field of Classification Search
CPC ..... E04G 11/28; E04G 13/06; E04G 13/066; E04G 21/02; B28B 1/14
USPC ..... 249/20; 425/65; 264/31, 33; 52/741.1, 52/745.05, 745.09
See application file for complete search history.

(56) References Cited

U.S. PATENT DOCUMENTS 836,369 A * 11/1906 Dexter ..... 29/527.1
1,393,506 A * 10/1921 Copeland ..... 425/65

(Continued)

FOREIGN PATENT DOCUMENTS

DE 2212118 * 9/1973 ..... E04G 11/28
DE 2361110 * 6/1975 ..... E04G 11/28

(Continued)

OTHER PUBLICATIONS

International Search Report and Written Opinion issued Feb. 1, 2011 for Application No. PCT/EP2010/054866.

*Primary Examiner* — Michael Safavi
(74) *Attorney, Agent, or Firm* — Pearne & Gordon LLP

(57) ABSTRACT

An adjustable Formwork climber apparatus is described which may be used for casting walls having an overhanging portion. The climber is used for supporting both vertical and horizontal formwork on the same supporting brackets. Adjustment mechanisms are provided for positioning or tilting the vertical and horizontal formwork. The adjustable formwork climber can be used both for casting continuous vertical structures, and for structures having an overhanging or protruding portion such as a ring-beam.

18 Claims, 6 Drawing Sheets

(56) References Cited

U.S. PATENT DOCUMENTS

| | | | | | |
|---|---|---|---|---|---|
| 3,472,477 | A | * | 10/1969 | Juhl | 249/219.1 |
| 4,355,453 | A | * | 10/1982 | Pause et al. | 29/460 |
| 4,478,385 | A | * | 10/1984 | Maier | 249/20 |
| 4,611,784 | A | * | 9/1986 | Gallis | 249/20 |
| 4,804,320 | A | * | 2/1989 | Sommer et al. | 425/65 |
| 7,513,480 | B2 | * | 4/2009 | Bergaretxe et al. | 249/20 |
| 8,464,996 | B2 | * | 6/2013 | Spindler et al. | 249/20 |
| 8,673,189 | B2 | * | 3/2014 | Schwoerer | 264/33 |
| 2009/0173574 | A1 | * | 7/2009 | Hobmeier | 182/82 |
| 2010/0038518 | A1 | * | 2/2010 | Schwoerer | 249/20 |

FOREIGN PATENT DOCUMENTS

| | | | | | |
|---|---|---|---|---|---|
| DE | 102005030336 | A1 | | 1/2007 | |
| DE | 102007018853 | A1 | * | 10/2008 | E04G 11/28 |
| EP | 0064183 | A2 | | 11/1982 | |
| FR | 1562186 | | * | 4/1969 | E04G 11/28 |
| FR | 2487410 | | * | 1/1982 | E04G 11/28 |
| GB | 1498422 | A | * | 1/1978 | E04G 11/28 |
| WO | 2009/117986 | A1 | | 10/2009 | |
| WO | WO 2011/087234 | | * | 7/2011 | E04G 11/28 |

* cited by examiner

ADJUSTABLE FORMWORK CLIMBER FOR CASTING A PROTRUDING REGION OF A STRUCTURE

The present invention relates to the field of constructing cast structures using temporary formwork. In particular, but not exclusively, the invention relates to formwork climbers used for casting vertical or inclined concrete structures.

Formwork, also known as shuttering, is a temporary retaining structure erected to define and support a volume which is to be filled with a casting material such as concrete.

A formwork climber is a supporting structure which bears the load of the formwork and the concrete and which transfers this load to the portion of the structure which has already been cast. In this way a high concrete wall, for example, can be cast without the need for scaffolding extending the full height of the wall; each new vertical section of wall can be cast on top of the previously cast section using a section of formwork which extends the height of the section being cast, and the formwork is supported by brackets mounted on the section of wall already cast. In the case of a free-standing wall, two separate formwork climbers are usually needed, one for each face of the wall, with opposing formwork separated by the thickness of the wall to be cast. In some cases, one formwork climber is equipped with means for supporting the formwork on both sides of the structure being cast (an example of such an arrangement is the so-called gallows-type climber). In either case, a series of adjacent climbers will usually be needed to provide formwork along the full length of the wall being cast.

Formwork climbers are successively raised and secured to the structure, then raised and secured again. Lifting of the formwork climbers can be by means of a crane, or jacks, for example. Some climbers comprise built-in lifting gear which can be used to, for example, climb up a set of rails attached to the structure being cast.

Formwork can be shaped and arranged to create many varied shapes of structure—flat vertical surfaces, inclined surfaces, curved (convex or concave) surfaces, with the formwork being constructed in sections, each section supported by a set of two or more brackets designed to be fixed directly or indirectly to the previously cast sections. In some instances, the climber may be mounted on rails which are secured to the previously cast section(s) of wall. In this patent application, a vertical wall is used by way of example. However, the invention described herein is also explicitly intended for casting inclined structures, or other structures with faces which are not strictly vertical in the narrowest meaning of the word. For this reason the terms "vertical" and "substantially vertical" when used in this description and the attached claims, are not intended to define a strict orientation relative to gravity. Rather, these terms should be understood to mean "vertically extending" in its most general sense, and to include all manner of inclined, curved, planar, continuous, discontinuous or irregularly-shaped surfaces. Similarly, "horizontal" is used to mean "horizontally extending", and is not intended to imply a strict definition of a particular orientation relative to the Earth's gravitational field.

European patent application EP0064183 discloses a formwork climber which can be secured to the previously cast wall section. The climber of EP0064183 incorporates a mechanism for retracting the formwork away from the newly-cast wall surface, and supports a working platform which provides access for construction personnel.

Existing formwork climbers, therefore, are adequate for casting a variety of structures having substantially planar surfaces. Some constructions, however, may require walls which incorporate portions whose surfaces cannot be cast by simply moving the formwork up in substantially the same plane. For example, walls for structures having a round or elliptical floorplan, such as a containment tank for gases or liquids, will often be designed with one or more reinforced concrete ring portions cast contiguously with the conventional portions of the wall, and with a ring-beam at the top of the wall. Post-tensioned reinforced concrete rings and ring beams may be incorporated where the wall on its own is not sufficiently strong in tension to retain radial outward forces on the wall. Such outward forces might be radial forces due to pressure from liquid stored inside a containment tank, for example, or due to the load of a domed roof. Incorporating a ring beam into a wall usually involves creating a significantly thicker portion of the wall, often at or near the top of the wall, and running around the circumference of a round, elliptical or otherwise curved construction. The thickness of the beam will depend on the amount of tension which is required in the post-tensioning tendons arranged within the beam.

Prior art methods of constructing such ring-beams, or similarly protruding or thickened portions, have relied on using standard formwork climbers for the main, substantially planar portions of the wall, and then a separate set of soffit formwork and supporting brackets for the wall-ring and ring-beam portions. In the case of a containment tank having a ring beam at the top of its main containing wall, for example, the wall is first cast using formwork climbers, up to the lower edge of the ring beam. Special fixing points are then cast into the top section of the wall, and these fixing points are subsequently used to mount additional brackets for the ring-beam soffit formwork. The part of the ring-beam which is directly above the wall will be supported by the wall. However, part of the ring-beam protrudes outwardly from the plane of the wall, and the weight of this part must be supported entirely by the additional formwork brackets.

Once the top section of the standard wall part is cast, the formwork climbers are moved outwards to form the vertical surface of the ring-beam or wall-ring portion, and the additional brackets and soffit formwork for the ring beam are installed. The ring-beam brackets are mounted on the special fixing points cast into the top section of wall, and the soffit formwork is fitted on to the additional brackets. Coarse positioning of the soffit formwork height is determined by the position of the fixing points and the brackets. Fine adjustment of the formwork height is performed using wedges between the formwork and the brackets. Opposed wedges are usually used.

The system of the prior art employs many separate parts, some of which must be custom-made for each construction. Erection and dismantling of the climber for the wall construction, followed by erection and dismantling of the ring-beam formwork for the overhanging portion(s), is time-consuming and labour-intensive, and requires more fixing points to be provided in the concrete. Each fixing point represents a point of relative weakness in the structure. It also requires frequent use of lifting equipment, such as a crane, which could be performing other tasks on the site.

The object of the present invention is thus to reduce the time and labour required to erect and dismantle the formwork for a cast structure having an overhanging part. A second object is to reduce the amount of equipment which is necessary for such a construction. A third object is to reduce the number of potential weak points in the structure. A fourth object is to reduce the use of lifting equipment required during the casting process.

These and other objects are satisfied by the invention, which envisages a formwork climber apparatus for casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the formwork climber apparatus comprising a first formwork member for delimiting a next section of the wall region to be cast, supporting means for securing the formwork climber apparatus to an already-cast section of the wall region such that the supporting means supports the first formwork member during each casting step, the formwork climber apparatus also comprising first formwork member positioning means for securing the first formwork member in a first position, in which the first formwork member delimits a next section of the wall region to be cast, or in a second position, in which the first formwork member delimits the protruding region to be cast, the supporting means is adapted to support the first formwork member in either of the first and second positions, and the supporting means is further adapted to support a second formwork member, the second formwork member being for delimiting the transition region during casting of the protruding region of the structure. Having vertical formwork and horizontal formwork on the same formwork climber enables the casting of virtually any shape of wall structure, including walls with overhanging portions.

According to an embodiment of the formwork climber apparatus of the invention, first adjustment means are provided for adjusting a vertical position and/or an orientation angle of the second formwork member relative to the supporting means. This feature means that the vertical positioning of the climber brackets is less critical, since any discrepancies can be compensated for. It also allows a precise positioning of the horizontal formwork, and the alignment of adjacent formwork elements, thus avoiding undesirable steps between neighbouring parts of the transition region of the structure.

According to a further embodiment of the formwork climber apparatus of the invention, second adjustment means are provided for adjusting, relative to the supporting means, a vertical position and/or an orientation angle of the first formwork member. Similar to the first adjustment means this feature allows a precise positioning of the vertical formwork, and the alignment of adjacent formwork elements, thus avoiding undesirable steps between neighbouring parts of the wall and/or protruding regions of the structure.

According to a further embodiment of the formwork climber apparatus of the invention, first formwork retraction means are provided for positioning the first formwork member in a third position, horizontally displaced from the surface of the region being cast, such that the first formwork can be prepared before casting and/or treated after casting. This feature allows the formwork to be moved away from the casting area and thereby afford easy access to the surface of the formwork for cleaning or preparation.

According to a further embodiment of the formwork climber apparatus of the invention, the second formwork member, the first adjustment means and/or the first formwork retraction means are adapted such that, during the casting of the wall region, the second formwork member can be positioned such that it does not obstruct any repositioning of the first formwork member between its first, second and third positions. Thus the horizontal, soffit formwork may be kept in position, but retracted out of the way during the casting of the conventional vertical wall sections, thereby avoiding the need to install the soffit formwork in a separate preparation operation before casting the protruding portion of the structure. Alternatively, the second formwork member may be removed altogether during any casting operations which only require the use of the first formwork member.

According to a further embodiment of the formwork climber apparatus of the invention, it comprises two or more bracket elements, each bracket element being secured to an already-cast section of the wall region by means of a fastening assembly comprising a threaded bolt element and a cast-in element, the cast-in element being removably castable into the structure. The use of a removable cast-in anchoring element allows the recovery and re-use of these potentially costly elements.

According to a further embodiment of the formwork climber apparatus of the invention, the threaded bolt element comprises a bolt head having a load-bearing face which is rounded and/or chamfered. The rounding or chamfering on the inside of the bolt head allows an angled orientation of the bracket, while maintaining evenly distributed load support by the bolt.

According to a further embodiment of the formwork climber apparatus of the invention, the cast-in element has a substantially conical form, and the cast-in element is provided with a flared load-transferring shoulder near an end of the cast-in element which faces out from the section in which the cast-in element is cast. The flared form improves the load transfer into the concrete.

The present invention also envisages a method of casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region. The method of the invention comprises a first step of securing a formwork climber apparatus to an already-cast section of the wall region of the structure, the formwork climber apparatus comprising a first, substantially vertical formwork member for delimiting a next-to-be-cast section of the wall region or a next-to-be-cast section of the protruding region of the structure, the formwork climber apparatus also comprising a second, substantially horizontal formwork member for delimiting the next-to-be-cast section of the protruding region of the structure. The method also comprises a second step of, while the formwork climber apparatus is fixed to the already-cast section of the wall region, casting the protruding region of the structure using the first formwork member to delimit the protruding region and the second formwork member to delimit the transition region. The use of a formwork climber whose vertical formwork member is capable of being used for casting either the conventional wall sections or the protruding (e.g. wall-ring or ring-beam) sections allows the same formwork climber to be used for the whole construction, without dismantling and replacing the climber during construction.

According to an embodiment of the invention, the method comprises the step of adjusting a vertical position and/or an orientation angle of the second formwork member. This allows a precise positioning of the vertical formwork, and the alignment of adjacent vertical formwork elements, thus avoiding undesirable steps between neighbouring parts of the wall and/or protruding regions of the structure.

According to an embodiment of the invention, the method comprises the step of adjusting a vertical position and/or an orientation angle of the first formwork member. This allows a precise positioning of the horizontal formwork, and the alignment of adjacent horizontal formwork elements, thus avoiding undesirable steps between neighbouring parts of the underside of the protruding regions of the structure.

According to an embodiment of the invention, the method comprises the step of adjusting the horizontal distance between the first formwork member and the vertically extending surface of the wall region of the structure. This allows positioning of the formwork where it is required for casting.

According to an embodiment of the invention, the method comprises the step of retracting the first formwork member to a position, horizontally displaced from the surface of the region being cast, such that the first formwork can be prepared before casting and/or treated after casting. This allows the vertical formwork to be moved away from the casting zone so that the formwork and the cast surface of the concrete can be cleaned and/or prepared.

According to an embodiment of the invention, the method comprises the step of using the formwork climber apparatus to cast one or more regions of the wall region of the structure, with the second formwork member being positioned such that it does not obstruct any repositioning of the first formwork member towards or away from the vertically extending surface of the structure. Thus the horizontal, soffit formwork can be kept mounted on the climber, but retracted to an out-of-the way position during the casting of the conventional wall sections, or any operations where the second formwork member is not required, thereby avoiding the need to install the soffit formwork in a separate preparation operation before casting the protruding portion of the structure. Alternatively, the second formwork member may be removed altogether during such operations.

According to another embodiment of the method of the invention, successive casting steps comprise installing anchor assemblies in the section being cast, for subsequently supporting the formwork climber apparatus for casting the next-to-be-cast section, and in which the anchor assemblies are of a first load bearing capacity if the next-to-be-cast section does not protrude relative to the section being cast, or of a second load-bearing capacity if the next-to-be-cast section does protrude relative to the section being cast, the second load-bearing capacity being greater than the first. The vertical load on the formwork climber of a protruding or overhanging portion of the volume to be cast is significantly greater that a non-protruding portion, so the load-bearing capacity of the anchor assemblies is chosen depending on the type of next-to-be-cast section. If the next-to-be-cast section is merely a continuation of the section currently being cast, or if there is only a modest overhang, then a conventional, relatively low-load anchor assembly may be used for supporting the formwork climber for casting the next section. If the next-to-be-cast section projects significantly outwards relative to the section currently being cast, then a significant extra load will be experienced when casting the next-to-be-cast section, and a suitably heavy-duty, high-load anchor assembly is cast into the current section being cast.

Other objects and advantages of the invention will become apparent from the following description and the accompanying drawings.

FIG. 1 of the drawings shows a sectional view of a part of an example structure to be cast using the apparatus and method of the invention.

Figure 1:
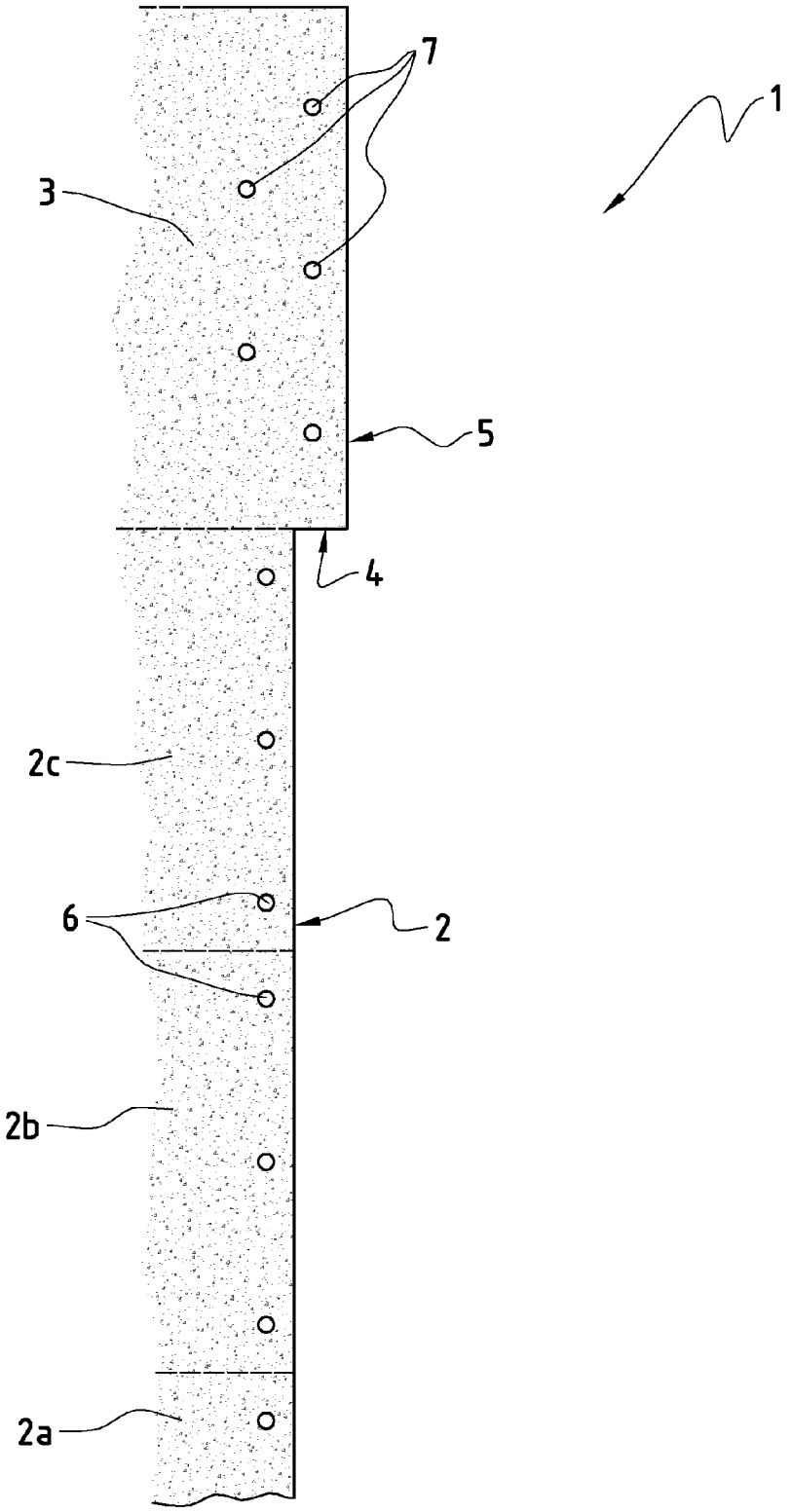

The drawings are provided to illustrate example implementations of the present invention, and to aid an understanding of the invention. They do not imply any restriction of the scope of the invention. In particular, although the drawings all depict the casting of a structure with one or more vertical faces, this should in no way be held to limit the scope of the invention to casting structures with strictly vertical faces. Indeed, it is explicitly the intention of the current application to provide for the casting of structures with all manner of inclined, curved or irregularly-shaped faces within the definition of the term "vertical".

Where the same reference numerals are used in more than one of the attached drawings, the numerals are intended to relate to the same or corresponding features.

FIG. 1 shows in schematic form a cross-sectional view of an example structure to be cast using the apparatus and method of the present invention. The example structure 1 is a solid construction, shown cast in four sections 2*a*, 2*b*, 2*c* and 3. The structure may be a wall-type construction, for example, with a wall part cast in three sections 2*a*, 2*b* and 2*c*, surmounted by a ring-beam 3. Reinforcement and post-tensioning tendons are indicated symbolically by tensioning elements 6 in the wall part 2*a*, 2*b* and 2*c*, and by ring-beam tensioning elements 7 in the upper section 3. The structure has an outer surface comprising the wall part surface 2, the upper ring-beam part surface 5 and a substantially horizontal step-type or transitional surface 4 which forms an overhang. The structure illustrated in FIG. 1 is a simple example of the kind of overhanging structure which can be cast using the present invention. In practice, the surface portions 2 and 5 may be differently shaped and/or inclined from the vertical. Similarly, the transition surface 4 shown as a horizontal surface in FIG. 1 may be a non-planar surface or may be inclined relative to the horizontal.

Figure 2:
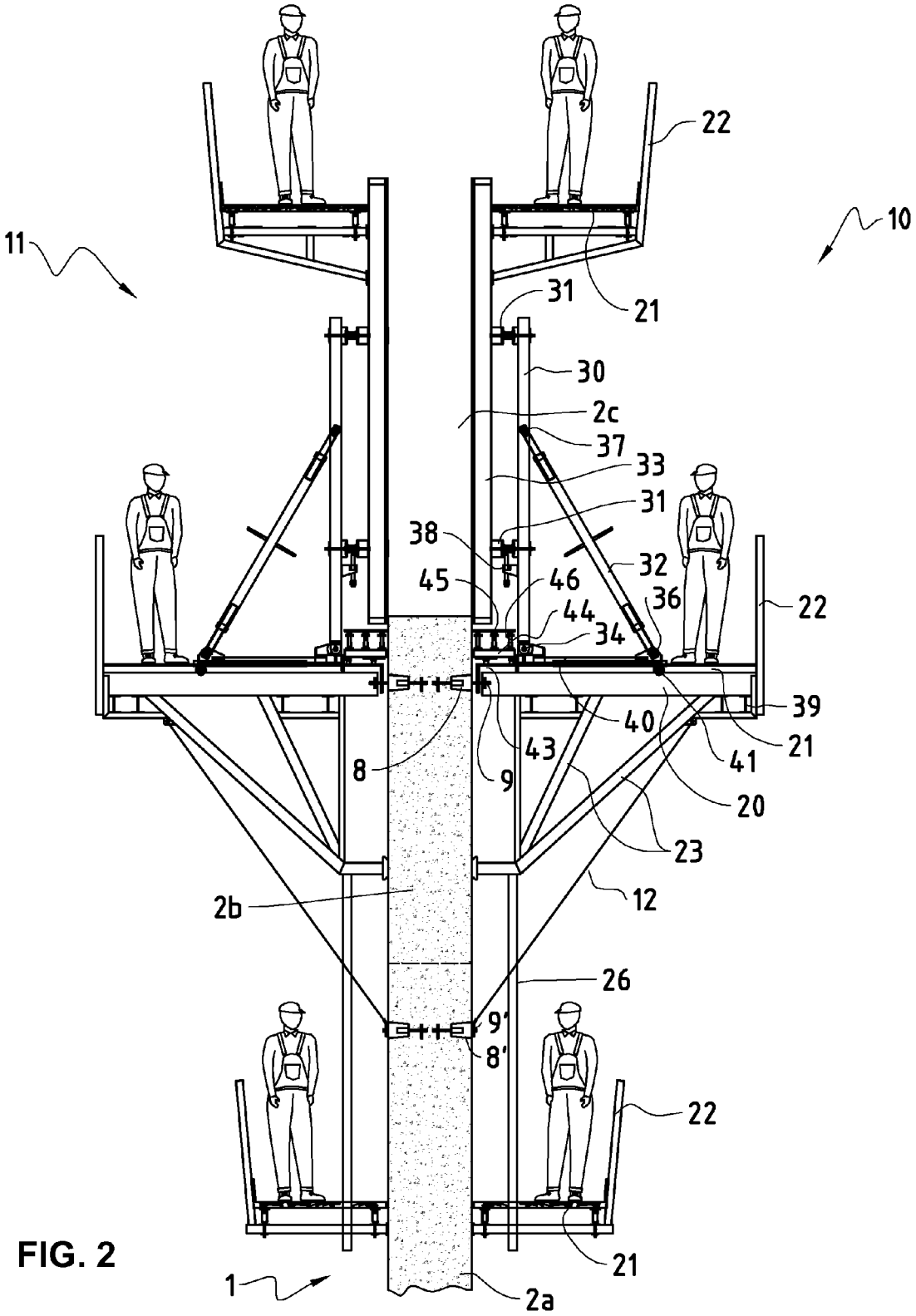
FIG. 2 shows a partly sectional view of two formwork climbers according to the invention being used to cast a vertical section of wall.

FIG. 2 shows two opposed formwork climbers 10 and 11 which can be used to implement the method of the present invention in the construction of a wall 2*a*, 2*b*, 2*c*. Each successive section of wall 2*a*, 2*b* etc is cast separately. FIG. 2 illustrates the climbers 10 and 11 mounted in position with vertical formwork 33 ready to cast section 2*c* of the wall. The formwork climbers 10 and 11 will be described in more detail with reference to climber 10, although it will be understood that the description also applies to the left-hand formwork climber 11.

Formwork climber 10 is a frame-like construction comprising a horizontal load-bearing beam 20, also referred to in this description as a bracket, secured to the already-cast section 2*b* of structure 1 by a fixing arrangement consisting of, for example, bolt 9, cone 8 and back-anchor 13. The climber apparatus normally comprises two or more such frames, spaced horizontally along the surface of the structure being cast. In the figures only one of the frames is shown for the sake of clarity.

Horizontal beam 20 is also supported by a bracing structure 23 for transferring the load to a lower part of the structure 1. Longitudinal beam elements 39, running for example horizontal and parallel to the face of the already-cast section 2*b*, may be used to spread the load across and between the two or more frames of which the formwork climber 10 is comprised.

Bracing structure 23 may comprise adjustable struts or turnbuckles which can be adjusted to vary the angle of the horizontal beam 20 relative to the surface of the structure to which it is mounted. The adjustable bracing means 23 enable the horizontal beam 20 to be mounted horizontally even when the climber is fixed to a surface which is inclined from the vertical. Or it can allow the horizontal beam 20 itself to be mounted at an angle which is inclined from the horizontal.

A bracing cable 12 may also be provided. This acts to hold the climber down on to its anchor mountings 8—for example in high winds or as a result of unexpected impacts.

In the example arrangement illustrated, each successive section 2*a*, 2*b*, 2*c* of structure 1 is cast with one set of anchor points 8, and the brace 12 for the current section 2*b* may be secured to the anchor point 8' of the previous section 2*a* using bolt or similar fastening 9'.

Also shown in FIG. 2 are working platforms 21 and safety rails 22, mounted above, beneath or at the same level as the horizontal beam 20.

As discussed above, climber frames are usually implemented in pairs, or in sets of more than two, spaced apart along the surface of the structure 1. Each pair or set of climber frames thus forms one formwork climber apparatus. In the apparatus of the invention, horizontal beams 20 are adapted to support vertical formwork 33, which is for casting sections with substantially vertical surfaces, and horizontal formwork 45, which is for casting sections having an overhanging, substantially horizontal surface portion. Sections 2*a*, 2*b* and 2*c* can be cast using only the vertical formwork 33 so, while the plain wall-type part 2 of the structure 1 is being constructed, the horizontal formwork 45 and its associated support structure 43, 44, 46 are removed or retracted so as not to obstruct the use of the vertical formwork 33.

Vertical formwork 33 is mounted on support member 30 using attachment elements 31. Some or all of the attachment elements 31 may be equipped with adjustment means which permit the adjustment of the height or angular orientation of the vertical formwork 33 relative to the support member 30. Such adjustment means are shown as threaded adjusters 38 in FIG. 2, although any suitable adjustment means could be used. The support member 30 is, in turn, adjustably mounted on a carriage mechanism 40, 41 which permits the formwork 33 to be moved horizontally towards and away from the desired casting position. Angle-adjuster 32 and pivot 34 permit the vertical formwork 33 to be deployed inclined from the vertical if necessary. Angle adjuster 32 is pivotably attached to the vertical formwork support 30 or the formwork 33 at pivot point 37, and to the carriage 40, 41 at pivot point 36. Vertical formwork 33 can thus be moved horizontally into position for casting using the carriage mechanism 40, 41. Similarly, the vertical formwork 33 can be moved away from the structure 1 between casting operations in order to facilitate the lifting of the climber, and so that the formwork 33 can be cleaned. These illustrated means of adjusting the angle, position and/or orientation of the vertical formwork 33 are examples of mechanical adjustment arrangements, and other means may of course be used.

Figure 3:
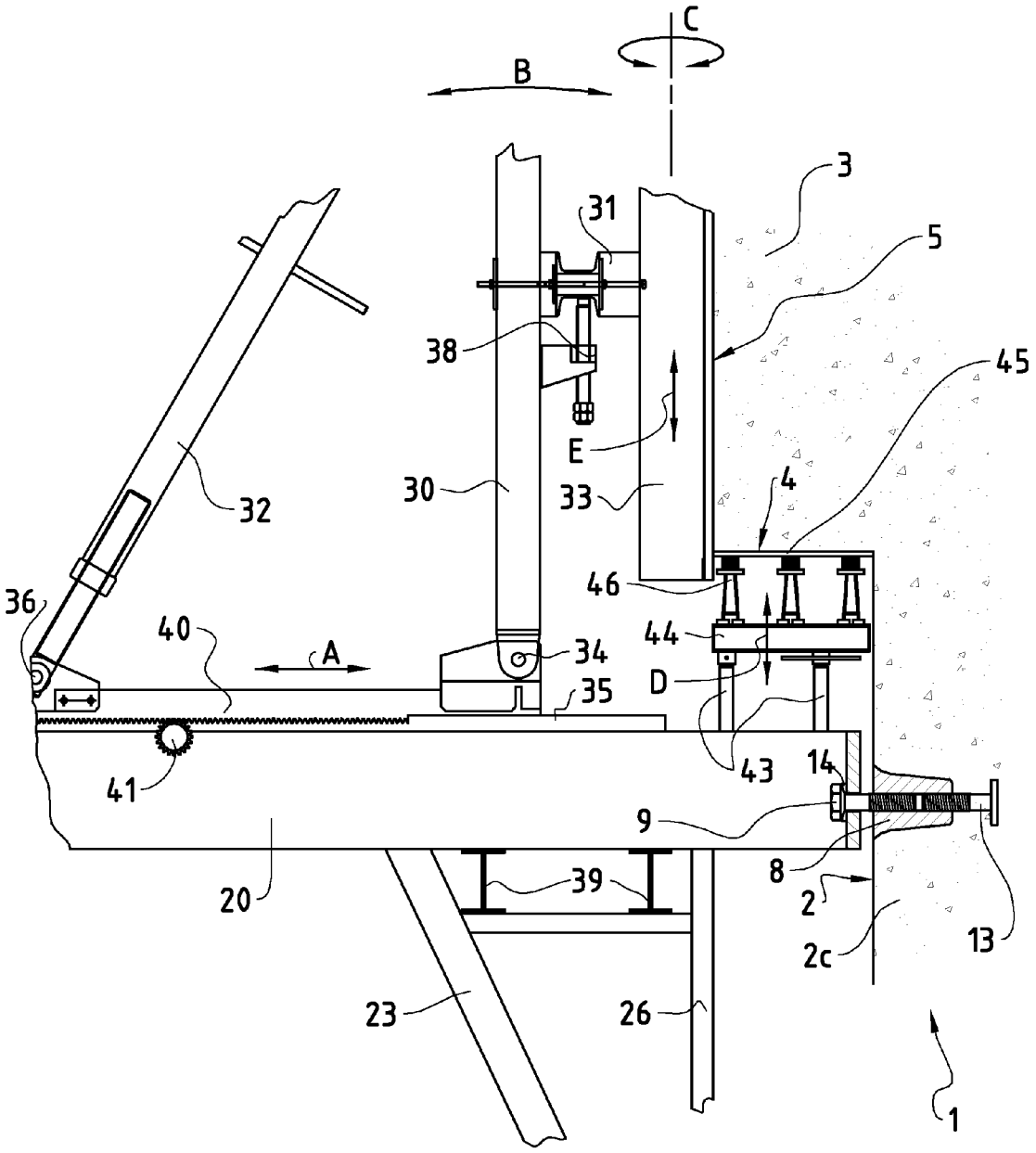
FIG. 3 shows in more detail a schematic representation of the adjustable horizontal formwork assembly used in the invention.

FIG. 3 shows in more detail the adjustable formwork mounting arrangement already described with reference to FIG. 2. In particular, FIG. 3 illustrates an example of how the horizontal formwork 45 and the vertical formwork 33 of the invention can be adjustably supported, and how the horizontal formwork 45 and vertical formwork 33 can be combined for casting an overhanging structure such as ring-beam portion 3 of structure 1.

Vertical formwork 33 is adjustably secured to support member 30 using attachment elements 31. Support member 30 is in turn supported on horizontal beam 20 by horizontal displacement means 40, 41, 35, which may for example be implemented as a rack 40 slidably engaged on a runner 35 and moved by rotating pinion 41. Other displacement means are of course also possible. Arrow A indicates the direction of travel of the formwork position horizontal position adjustment. The vertical formwork 33 can also be inclined with respect to the vertical angle adjustment means 32 (arrow B) and/or otherwise angled by means of adjustable mounts. Arrow C indicates in an exaggerated fashion how the vertical formwork 33 can be rotated slightly about a vertical axis by means of the various adjustable mounts.

Vertical adjustment of the vertical formwork 33 is also possible, using adjusters 38. While the vertical position of vertical formwork 33 is coarsely prescribed by the position of mounts 8, and therefore horizontal beams 20, it can be finely set using vertical formwork vertical adjusters 38. This can be useful, for example, when matching the vertical position of the vertical formwork 33 relative to that of the horizontal (soffit) formwork 45.

FIG. 3 shows horizontal formwork 45 supported by various elements 43, 44 and 46 such that the height of the horizontal formwork 45 can be adjusted. Arrow D indicates the direction of vertical adjustment. In the example illustrated, horizontal formwork 45 may be a simple ply board supported by spacers 46. The spacers 46 are in turn supported by a spreader beam 44 supported by height adjusters 43. The spreader beam 44 and the spacers 46 are designed to bear the weight of the concrete above the horizontal formwork 45 without becoming significantly distorted. Interchangeable spacers 46 of various heights may be used to provide a coarse height adjustment, while the fine height adjustment is provided by height adjusters 43. Height adjusters 43 may be any kind of jack-like or other support device which can be adjusted and which can bear the required weight of concrete above it. The height adjusters 43 may be coupled together such that one adjustment operation adjusts all the height adjusters 43 simultaneously for one spreader beam 44, or they may be independently adjustable such that, by setting the various height adjusters 43 at different heights, an inclined formwork 45 may be achieved. A curved or otherwise shaped step surface 4 may be also achieved by means of suitably shaped formwork 45 and spacers 46.

The fixing anchor may be implemented as a multi-component anchor assembly comprising, for example, a threaded lost anchoring part 13 cast permanently into the concrete, a retrievable, conical element 8, also cast into the concrete and secured removably to the anchoring part 13, and a bolt 9 for fastening the bracket 20, 23, 26 to the conical element 8. The bracket 20, 23, 26 and the fixing anchor arrangement 8, 9, 13, 14 must be capable of supporting the vertical load of the concrete above the horizontal formwork (and therefore the ring-beam concrete) as well as resisting the horizontal outward force component (i.e. away from the surface of structure 1) of the angular moment due to the vertical weight loading. The bracket 20 and the horizontal formwork assembly 4, 43, 44, 45 are arranged, as shown in FIG. 3, such that the weight of the concrete is supported close in to wall surface, and hence as close as possible to the anchoring points. The horizontal outward force component on the anchor assembly can thereby be minimised.

In a variant of the invention, the heads of the bolts 9 are provided with a rounded or chamfered inner face. This is indicated in FIG. 3. Optionally, a correspondingly-shaped washer 14 may also be fitted between the head of bolt 9 and the part of the bracket 20 to be secured. Alternatively, such a washer may be integrated into the bolt head design. The reasons for using such rounded bolt head inner surface are as follows: pairs of support brackets 20 are usually mounted parallel to each other, so that the vertical formwork can be moved in and out along parallel runners 35 on the bracket support members 20. However, some structures, such as the containment vessels mentioned earlier, have curved walls, so pairs or sets of parallel brackets must inevitably be mounted at an angle to the surface. Instead of providing a custom-made angled end to the bracket for each new project, which would be expensive and time-consuming, or a variable-angle end to the bracket, which would be less strong, a bracket with a flat end is preferred. However, the conical elements 8 are usually cast into the structure 1 such that bolts 9 are fitted normal to the surface of the structure 1. When the brackets 20 are mounted on the bolts 9 at an angle to the longitudinal axis of the bolt 9, the flat plate end of the bracket 20 will be at an angle to the inner (load-bearing) face of the bolt head 9. The contact area between the bolt head and the end plate of the bracket 20 will thus be extremely small, and the horizontal forces borne by the bolt 9 will thus be applied all at one small region of the inner face of the bolt head, which may result in distortion of the bolt 9 or the plate, or possibly failure of either part. By providing the bolt head with a rounded or chamfered inner face, the mating surface area between the bolt head and the flat plate can be increased, thus reducing the likelihood of distortion or damage.

FIG. 3 also illustrates another variant of the invention, wherein the conical element 8 is provided with a load-transferring shoulder in the form of a flaring of the conical element 8 in an outer region nearer to the outer surface of the structure 1. The load-transferring shoulder can be a discontinuous change of angle of the outer surface of the conical element 8, or it can be formed with a continuous or varying curvature, or a combination of these profile types. The load-transferring shoulder serves to improve static load transfer from the bracket 20, via the bolt 9, into the concrete. In this way, the load-bearing properties of the conical anchor element can be greatly enhanced. The conical elements with the extra load-transferring shoulder can be used wherever conical elements are required to be cast in, or they can be reserved for those anchoring points which will be required to bear the load of the ring-beam while it is cast. In practice, it has been found that a conical anchor element equipped with a load-transferring shoulder can be capable of bearing a vertical load of more than 50 kN, and up to 200 kN or even more, without causing any significant degradation of the concrete surrounding the anchor cone 8 and the lost anchor part 13. Such heavy-duty, high-load anchor elements may be used for supporting the formwork climber for casting ring-beam sections, where the vertical loading is much greater than the conventionally-cast, non-overhanging, sections 2*a*, 2*b*, 2*c* of the structure 1.

Also indicated in FIG. 3 are some of the degrees of freedom which are afforded by the apparatus of the invention. Double-ended arrow A, for example, indicates the movement of the carriage 40 which supports the vertical formwork towards and away from the structure being cast. The displacement mechanism 35, 40, 41 may be implemented in a number of different ways. It must however be such that the vertical formwork can be held stationary while the concrete section is cast. Double-ended arrow B indicates how the vertical formwork 33 can be tilted about pivot point 34. This tilting is controlled by angle adjuster unit 32. Double-ended arrow C in intended to indicate one of the degrees of freedom of movement of the vertical formwork 33 which can be achieved by means of individual rotational adjusters (not shown). Double-ended arrow D indicates the vertical displacement of the horizontal formwork 45. The vertical displacement means 43, for example screw-jacks, can also be adjusted individually to incline the horizontal formwork 45 in any direction away from the horizontal. The vertical displacement means 43 can be used for bringing the formwork into position, bearing the weight of the casting material above it, and for lowering the formwork again after the casting is complete. Double-ended arrow E indicates how the vertical position of vertical formwork can be adjusted using vertical formwork vertical adjusters 38.

Figure 4:
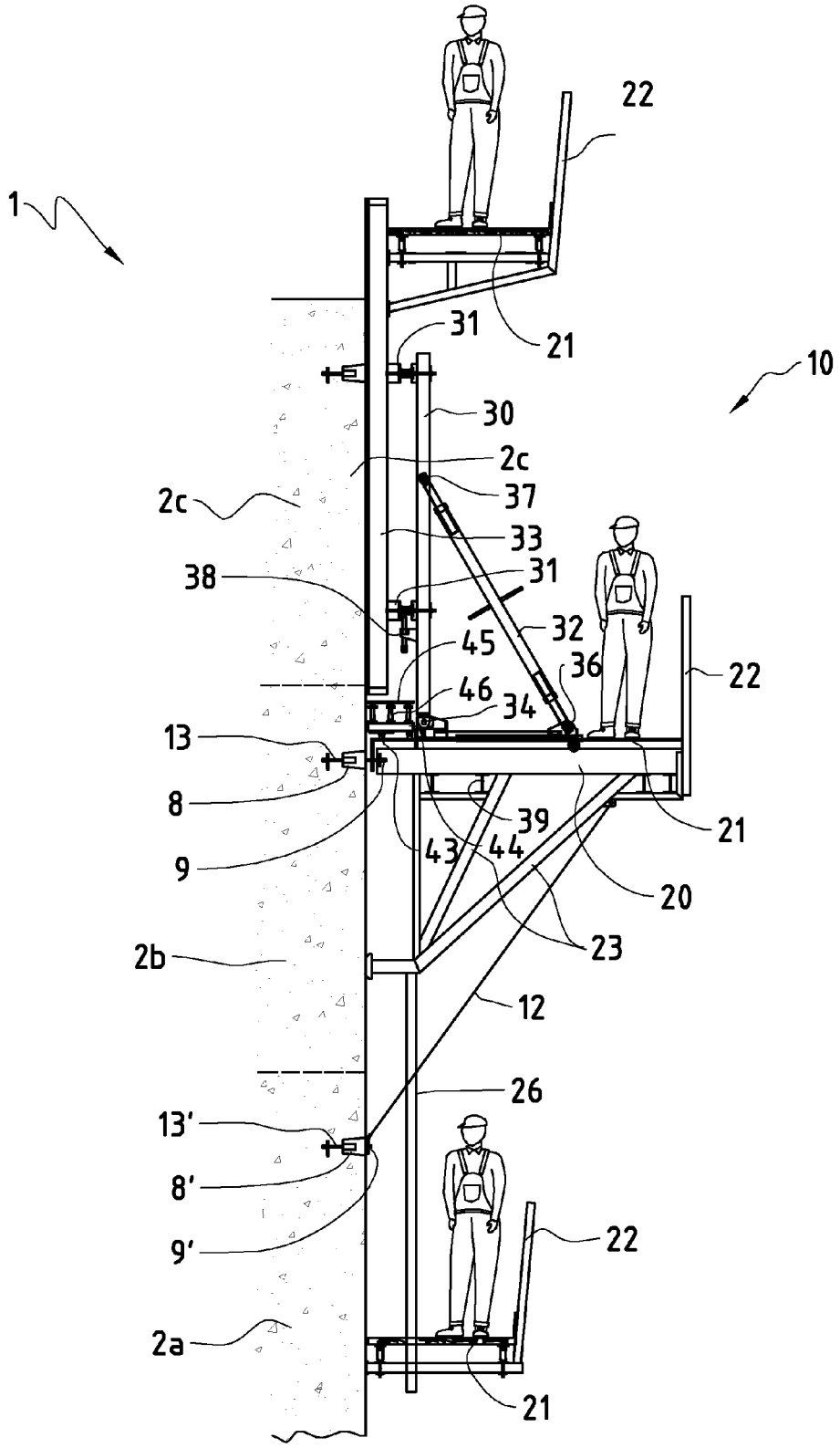
FIG. 4 shows one side of the arrangement shown in FIG. 2, illustrating how the formwork climber is raised to cast the next vertical section of wall.
Figure 5:
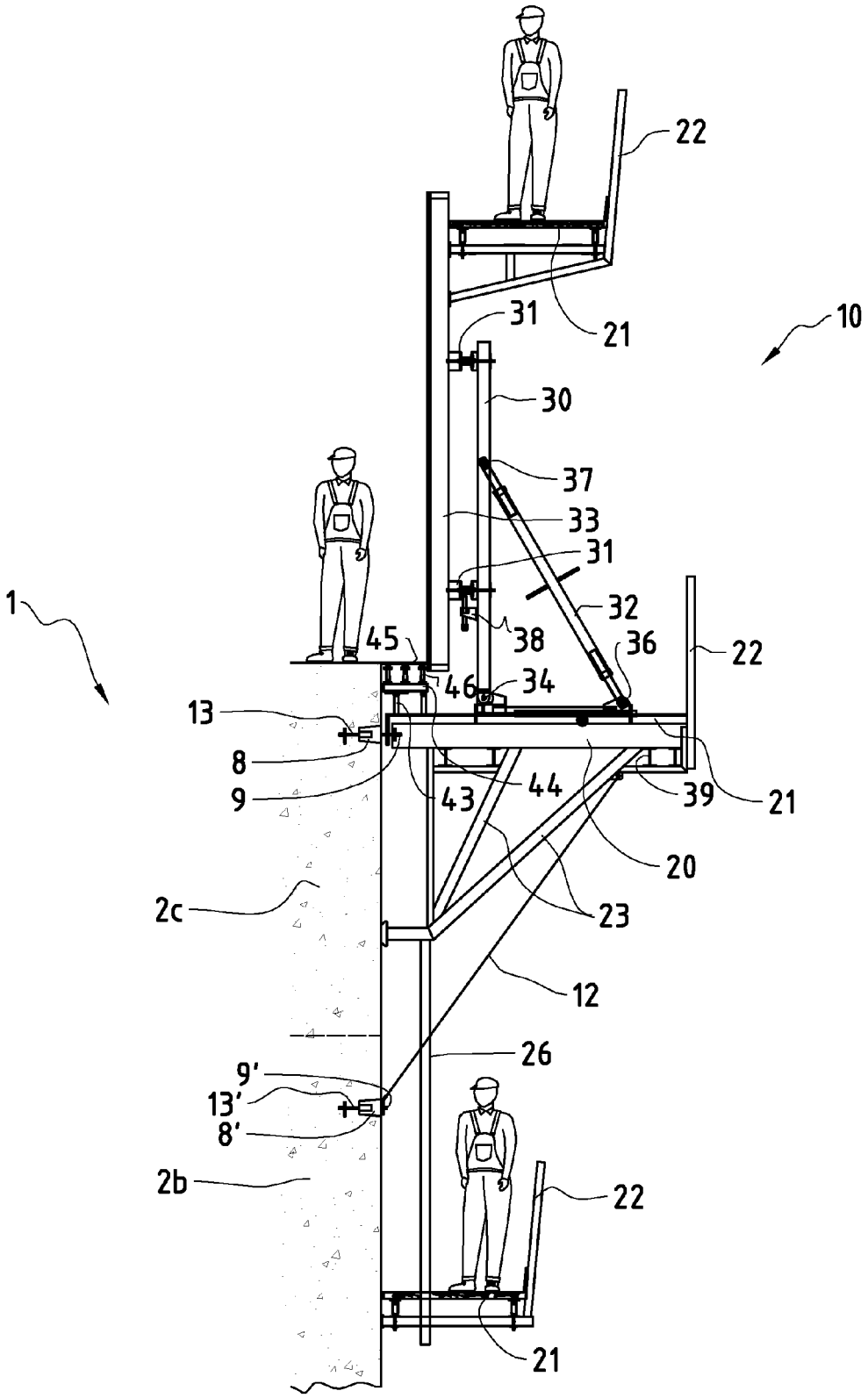
FIG. 5 shows how the adjustable horizontal and vertical formwork elements of the formwork climber are deployed ready for casting an overhanging part of the structure.
Figure 6:
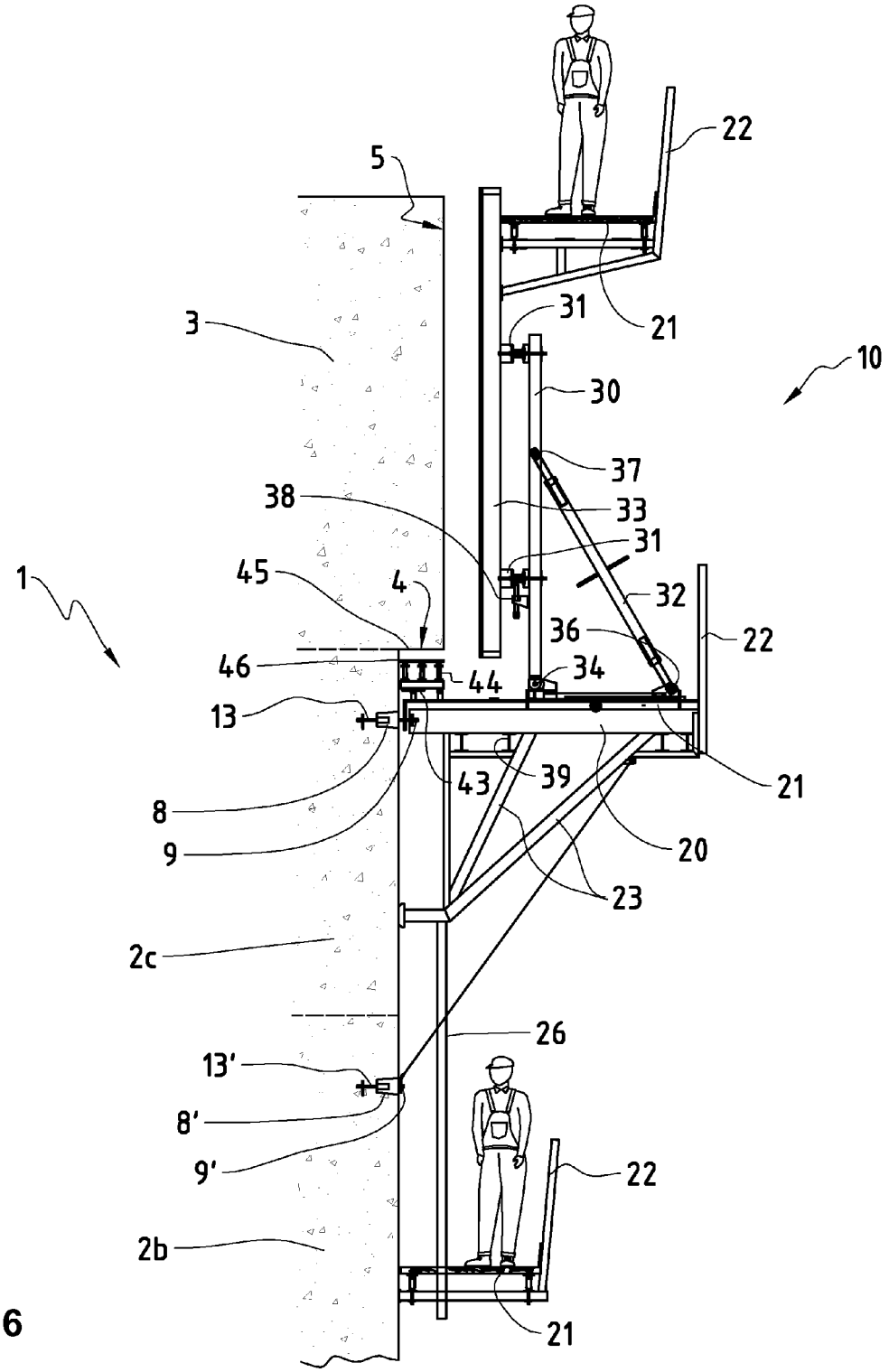
FIG. 6 shows the overhanging part of the structure after casting, with the horizontal formwork lowered and the vertical formwork retracted.

FIGS. 4 to 6 show further steps in casting the example structure of FIG. 1. Only one side of the casting and one formwork climber are shown in these figures, for the sake of clarity. FIG. 4 shows a situation following that of FIG. 2, in which the concrete has been cast in section 2*c*. In FIG. 5, the formwork climber 10 is raised in preparation for casting a ring-beam section 3 on top of the already-cast section 2*c* of wall 1. FIG. 5 shows the horizontal formwork 45 in position, ready to support the weight of the overhanging part of the ring beam 3 while the concrete sets. FIG. 6 shows the same arrangement as in FIG. 5, but after casting has been carried out, and when the casting material (concrete, for example) is sufficiently cured that the vertical and horizontal formwork 33 and 45 can be retracted away from the cast material to the positions shown.

Note that, although the two anchors 8,13 and 8',13' appear to be similar to each other in FIGS. 5 and 6, the upper anchor 8,13 may advantageously be a heavy-duty anchor, such as the anchor shown in FIG. 3, capable of bearing the significant extra vertical load of the ring-beam section 3, while the lower anchor, 8'13', is implemented as a more conventional, less heavy-duty anchor such as is normally used for supporting formwork climbers.

The invention claimed is:

1. Formwork climber apparatus for casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the formwork climber apparatus comprising:

a first, substantially vertical formwork member for delimiting a next-to-be-cast section of the wall region or a next-to-be-cast section of the protruding region of the structure, supporting means for securing the formwork climber apparatus to an already-cast section of the wall region such that the supporting means supports the first formwork member during each casting step, first formwork member positioning means for securing the first formwork member in a first position, in which the first formwork member delimits a next section of the wall region to be cast, or in a second position, in which the first formwork member delimits the protruding region to be cast, a second, substantially horizontal formwork member for delimiting the transition region during casting of the protruding region of the structure, and a second formwork member positioning means for adjusting the height of the second formwork member, wherein the supporting means is adapted to support the first formwork member in either of the first and second positions and to support the second formwork member.

2. Formwork climber apparatus according to claim 1, comprising first adjustment means for adjusting a vertical position and/or an orientation angle of the second formwork member relative to the supporting means.

3. Formwork climber apparatus according to claim 2, comprising second adjustment means for adjusting, relative to the supporting means, a vertical position and/or an orientation angle of the first formwork member.

4. Formwork climber apparatus according to claim 3, comprising first formwork retraction means for positioning the first formwork member in a third position, horizontally displaced from the surface of the region being cast, such that the first formwork member can be prepared before casting and/or treated after casting.

5. Formwork climber apparatus according to claim 4, wherein the second formwork member, the first adjustment means and/or the first formwork refraction means are such that, during the casting of the wall region, the second formwork member can be positioned such that it does not obstruct any repositioning of the first formwork member between its first, second and third positions.

6. Formwork climber apparatus according to claim 1 comprising two or more bracket elements, each bracket element being secured to an already-cast section of the wall region by means of a fastening assembly comprising a threaded bolt element and a cast-in element, the cast-in element being removably castable into the structure.

7. Formwork climber apparatus according to claim 6, in which the threaded bolt element comprises a bolt head having a load-bearing face which is rounded and/or chamfered.

8. Formwork climber apparatus according to claim 6, wherein the cast-in element has a substantially conical form, and wherein the cast-in element is provided with a flared load-transferring shoulder near an end of the cast-in element which faces out from the section in which the cast-in element is cast.

9. Method of casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the method comprising a first step of securing a formwork climber apparatus to an already-cast section of the wall region of the structure, the formwork climber apparatus comprising a first, substantially vertical formwork member for delimiting a next-to-be-cast section of the wall region or a next-to-be-cast section of the protruding region of the structure, the formwork climber apparatus also comprising a second, substantially horizontal formwork member for delimiting the next-to-be-cast section of the transition region-of the structure;

a second step of, while the formwork climber apparatus is fixed to the already-cast section of the wall region, casting the protruding region of the structure using the first formwork member to delimit the protruding region and the second formwork member to delimit the transition region.

10. Method according to claim 9, comprising the step of adjusting a vertical position and/or an orientation angle of the second formwork member.

11. Method according to claim 9, comprising the step of adjusting a vertical position and/or an orientation angle of the first formwork member.

12. Method according to claim 9, comprising the step of adjusting the horizontal distance between the first formwork member and the vertically extending surface of the wall region of the structure.

13. Method according to claim 9, comprising the step of retracting the first formwork member to a position, horizontally displaced from the surface of the region being cast, such that the first formwork member can be prepared before casting and/or treated after casting.

14. Method according to claim 9, comprising the step of using the formwork climber apparatus to cast one or more regions of the wall region of the structure, with the second formwork member positioned such that it does not obstruct any repositioning of the first formwork member towards or away from the vertically extending surface of the structure.

15. Method according to claim 9, in which successive casting steps comprise installing anchor assemblies in the section being cast, for subsequently supporting the formwork climber apparatus in casting the next-to-be-cast section, and in which the anchor assemblies are selected having a first load bearing capacity if the next-to-be-cast section does not protrude relative to the section being cast, or having a second load-bearing capacity if the next-to-be-cast section does protrude relative to the section being cast, the second load-bearing capacity being greater than the first.

16. Formwork climber apparatus for casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the formwork climber apparatus comprising:

a first, substantially vertical formwork member that delimits a next-to-be-cast section of the wall region or a next-to-be-cast section of the protruding region of the structure, support structure that secures the formwork climber apparatus to an already-cast section of the wall region such that the support structure supports the first formwork member during each casting step, first formwork member positioning device that secures the first formwork member in a first position, in which the first formwork member delimits a next section of the wall region to be cast, or in a second position, in which the first formwork member delimits the protruding region to be cast, a second, substantially horizontal formwork member that delimits the transition region during casting of the protruding region of the structure, and a second formwork member positioning device that adjusts the height of said second formwork member, wherein said support structure supports said first formwork member in either of the first and second positions and supports said second formwork member.

17. Formwork climber apparatus for casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the formwork climber apparatus comprising:

a first, substantially vertical formwork member for delimiting a next-to-be-cast section of the wall region or a next-to-be-cast section of the protruding region of the structure, supporting means for securing the formwork climber apparatus to an already-cast section of the wall region such that the supporting means supports the first formwork member during each casting step, first formwork member positioning means for securing the first formwork member in a first position, in which the first formwork member delimits a next section of the wall region to be cast, or in a second position, in which the first formwork member delimits the protruding region to be cast, wherein the supporting means is adapted to support the first formwork member in either of the first and second positions, and the supporting means is further adapted to support a second, substantially horizontal formwork member, the second formwork member being for delimiting the transition region during casting of the protruding region of the structure, two or more bracket elements, each bracket element being secured to an already-cast section of the wall region by means of a fastening assembly comprising a threaded bolt element and a cast-in element, the cast-in element being removably castable into the structure, wherein the threaded bolt element comprises a bolt head having a load-bearing face which is rounded and/or chamfered.

18. Formwork climber apparatus for casting a structure in a plurality of successive casting steps, the structure having a vertically extending surface, the vertical extent of the surface comprising a first, substantially vertical, wall region, a second, substantially vertical, protruding region above the wall region, and a third, substantially non-vertical, transition region extending between an upper part of the wall region and a lower part of the protruding region, the formwork climber apparatus comprising:

a first, substantially vertical formwork member for delimiting a next-to-be-cast section of the wall region or a next-to-be-cast section of the protruding region of the structure, supporting means for securing the formwork climber apparatus to an already-cast section of the wall region such that the supporting means supports the first formwork member during each casting step, first formwork member positioning means for securing the first formwork member in a first position, in which the first formwork member delimits a next section of the wall region to be cast, or in a second position, in which the first formwork member delimits the protruding region to be cast, wherein the supporting means is adapted to support the first formwork member in either of the first and second positions, and the supporting means is further adapted to support a second, substantially horizontal formwork member, the second formwork member being for delimiting the transition region during casting of the protruding region of the structure, two or more bracket elements, each bracket element being secured to an already-cast section of the wall region by means of a fastening assembly comprising a threaded bolt element and a cast-in element, the cast-in element being removably castable into the structure, wherein the cast-in element has a substantially conical form, and wherein the cast-in element is provided with a flared load-transferring shoulder near an end of the cast-in element which faces out from the section in which the cast-in element is cast.

* * * * *